United States Patent [19]

Schlau et al.

[11] 4,127,377

[45] Nov. 28, 1978

[54] STAMP DESIGN KIT

[75] Inventors: Floyd E. Schlau, East Greenwich, R.I.; Harry Disko, South Barrington; Derek A. Brand, Naperville, both of Ill.

[73] Assignee: Marvin Glass & Associates, Chicago, Ill.

[21] Appl. No.: 767,396

[22] Filed: Feb. 14, 1977

[51] Int. Cl.[2] ..... B28B 1/00

[52] U.S. Cl. ..... 425/385; 33/27 L; 33/27 G

[58] Field of Search ..... 425/385, 457, 472; 33/27 L, 27 G, 18 R

[56] References Cited

U.S. PATENT DOCUMENTS

| | | | |
|---|---|---|---|
| 727,646 | 5/1903 | Leary | 425/385 X |
| 850,552 | 4/1907 | Werner | 33/27 G X |
| 1,254,003 | 1/1918 | Stainkamp | 33/27 L |
| 2,579,290 | 12/1951 | Bachmann | 33/27 L |
| 2,920,583 | 1/1960 | Carpenter | 425/385 X |
| 3,323,569 | 6/1967 | Benischek | 425/385 X |
| 3,425,105 | 2/1969 | Gulde | 425/434 X |
| 3,484,797 | 12/1969 | Barnett et al. | 33/27 L X |
| 4,028,033 | 6/1977 | Bryant | 425/385 X |

FOREIGN PATENT DOCUMENTS

| | | | |
|---|---|---|---|
| 760,983 | 12/1933 | France | 425/385 |

*Primary Examiner*—Robert L. Spicer

*Attorney, Agent, or Firm*—Mason, Kolehmainen, Rathburn & Wyss

[57] ABSTRACT

An arts and crafts type clay stamping kit which includes a base and a receptacle on the base for receiving a batch of clay or the like. A selectively movable support arm is mounted on the base for movement at least between a first position spaced from the receptacle to permit loading the receptacle with clay and a second position adjacent the receptacle. An impression forming member is provided on the support arm for movement therewith and for contacting the clay at the receptacle to impress a design in the clay when the support arm is in its second position.

24 Claims, 5 Drawing Figures

STAMP DESIGN KIT

BACKGROUND AND SUMMARY OF THE INVENTION

This invention relates to arts and crafts and, in particular, to a stamping kit which permits repetitive or sequential stamping designs on clay or the like.

Devices which enable generally unskilled or amateur individuals, such as children, to participate in various arts and crafts have been well received by the public. Some of such devices simply are machines which mechanically reproduce a design or the like which is pleasing to the eye while the device is very simple to operate. Other types of craft kits require a great degree of skill in order to operate to produce a finished product and therefore many children are discouraged from attempting to utilize these types of devices. In addition, one type of play material which is very popular with children is clay or other moldable material which can be utilized to develop creativity and dexterity while working with the clay. The present device is a stamping kit which permits stamping designs in a batch of clay positionable on the device.

In the exemplary embodiment of the invention, a kit for impressing designs in clay or the like is provided and includes a base with a platen thereon rotatable relative to the base about a generally vertical axis. A receptacle in the form of a tray is provided on top of the platen for receiving a batch of clay or the like. A manually manipulatable ratchet and pawl mechanism is provided for rotating the platen and clay receptacle in discrete, generally equal increments to provide for sequential impressing of designs in various patterns into the clay either repetitively or sequentially. A support arm is mounted on the base by a pivotal connection which permits the support arm to be selectively movable between a first position spaced upwardly from the receptacle to permit loading the receptacle with clay and a second position adjacent the receptacle. Means is provided to selectively hold the support arm in its first position to permit loading the receptacle with clay. The support arm also is movable in a horizontal direction relative to the receptacle. A plurality of interchangeable impression forming members are removably mountable on the support arm at various positions thereon to furthr enhance the ability of the child to create enumerable designs on the clay in the receptacle.

Other objects, features and advantages of the invention will be apparent from the following detailed description taken in connection with the accompanying drawings.

DETAILED DESCRIPTION OF THE INVENTION

Figure 1:
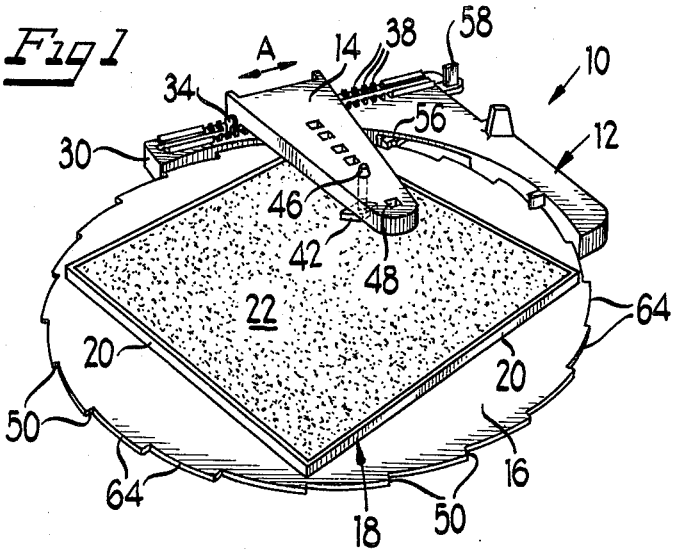
FIG. 1 is a perspective view of the clay stamping kit of the present invention, with the support arm and impression forming member thereon in its down impressing position.

Referring to the drawings in greater detail, the clay stamping kit of the present invention, generally designated 10, includes a lower rectangular base, generally designated 12, which mounts a movable support arm 14 and an upper horizontally rotatable platen 16. The platen 16 is generally circular and has a generally square receptacle, generally designated 18, formed on the top thereof by four upstanding walls 20 within which a batch of clay 22 is positionable.

Figure 4:
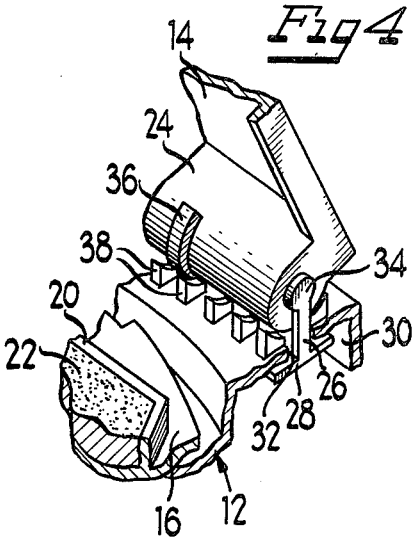
FIG. 4 is a fragmented perspective view showing the means for locking the support arm in its raised or loading position.
Figure 2:
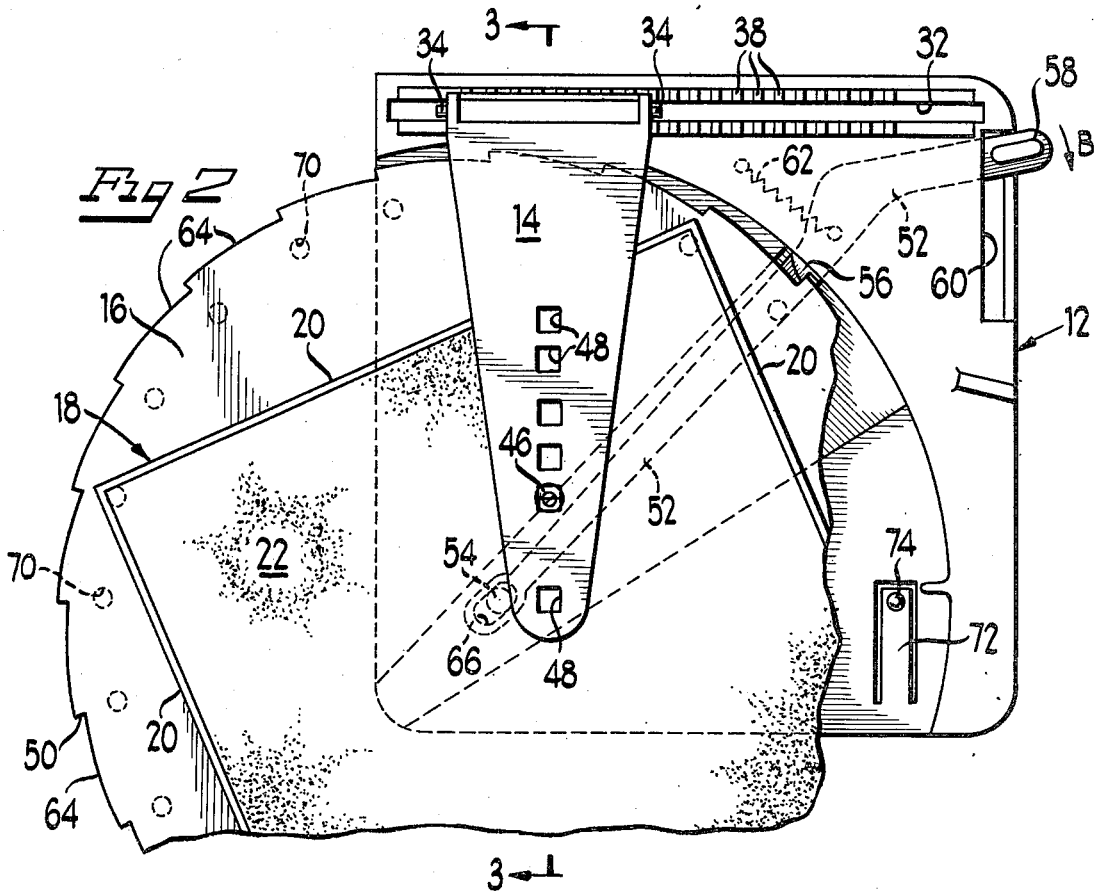
FIG. 2 is a fragmentary top plan view, on an enlarged scale, of the clay stamping kit of FIG. 1.
Figure 3:
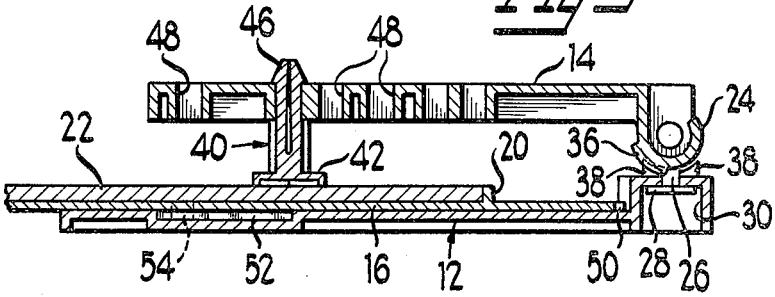
FIG. 3 is a vertical sectional view taken generally along the line 3—3 of FIG. 2.

Referring in greater detail to the support arm 14 and the mounting therefor on top of the base 12, the support arm 14 has a rounded pivot portion 24 (FIGS. 3 and 4) to provide pivoting of the support arm in a vertical direction so as to move the support arm upwardly to a locked position (see FIG. 4) described hereinafter and a lower impressing position as shown in FIGS. 1 and 2. More particularly, the rounded portion 24 is pivotally mounted by a T-shaped flange, generally designated 26, which terminates at its lower end in a generally flat horizontal plate portion 28 which lies within a channel 30 formed on the underside of the base 12. The vertical leg of the T-shaped member extends through an elongated slot 32 at the top of the channel 30. The T-shaped member 26 has a shaft portion 34 extending through the rounded portion 24 of the support arm to provide the aforesaid vertical reciprocating motion. Alternatively, the support arm 14 could be mounted by a gimbal connection to provide universal movement of the support arm 14 relative to the base 12. The support arm is movable horizontally back and forth in the direction of the double-headed arrow A (FIG. 1) to permit adjusting the horizontal position of the support arm.

Means is provided to hold the support arm in its raised position to permit loading the receptacle 18 with the clay 22 and to assure horizontal alignment of the support arm. More particularly, referring specifically to FIG. 4, a rounded locking ridge 36 is formed on the inside of the rounded portion 24 of the support arm and a plurality of spaced upstanding bosses 38 are formed on top of the channel 30 of the base. In order to hold the support arm in its raised or locked position, the support arm simply is laterally positioned so that the rounded ridge 36 engages the top of one of the bosses 28 to hold the support arm upwardly. In order to move the support arm downwardly to an impressing position, the support arm is moved to a selective position so that the rounded ridge 36 passes between a selected pair of the bosses 38.

Figure 5:
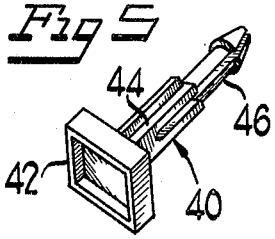
FIG. 5 is a perspective view of one of the impression forming members of the present invention.

The clay stamping kit of the present invention includes a plurality of interchangeable impression forming members, generally designated 40, one of which is shown in FIG. 5. Each impression forming member has an impression forming portion 42 (the one shown in FIG. 5 being a square configuration) and a shaft portion 44 which terminates in a slotted snap protrusion 46. The support arm 14 is provided with a series of square shaped apertures 48 extending radially thereof for receiving the snap protrusion 46 of the impression forming members with the impression forming portion 42 thereof facing downwardly for engagement with the clay 22 in the receptacle 18.

Thus, it can be seen that the support arm 14 not only can be shifted laterally in the direction of arrow A to selectively position any one or more of the impression forming members 40 at a selected position for impressing designs into the clay 22, but an impression forming member also can be placed at selected positions longitudinally or radially along the support arm. In addition, by providing the plural square apertures 48 through the support arm, more than one impression forming member 40 can be positioned thereon to further facilitate a child creating enumerable designs on the clay 22 in the receptacle 18.

Means is provided in the form of a ratchet and pawl mechanism to incrementally rotate the platen 16 and clay receptacle 18 to change the angular relationship of the clay 22 in the receptacle relative to the position of the support arm 14 and the impression forming member or members 40 thereon. More particularly, it can be seen from FIGS. 1 and 2 that the outer circular periphery of the platen 16 has generally equally spaced ratchet teeth or shoulders 50. Of course, the ratchet teeth can be unequally spaced if desired. A lever-pawl arm 52 is mounted on the base 12 by means of a pivot pin 54 which also provides the pivot for the platen 16. The lever arm 52 has a pawl tooth 56 (FIG. 2) for engaging the rachet teeth 50 about the periphery of the platen 16. The outer end of the platen is provided with a handle portion 58 extending through a slot 60 in the base 12 for grasping by a user and movement in the direction of arrow B (FIG. 2) to increment the platen 16 rotationally in the same direction by engagement of the pawl tooth 56 on the lever 52 with the adjacent one of the ratchet teeth 50.

The lever arm 52 is returned to its original position as shown in FIG. 2 by a coil spring 62. The peripheral portions 64 about the platen 16 between the ratchet teeth 50 are curved in shape and the pawl tooth 56 of the lever 52 rides therealong in order to return to its original position described above. However, longitudinal lost motion of the lever 52 must be provided in order to accommodate the radial distance between the inner edge of each ratchet tooth 50 and the outer edge of the next adjacent ratchet tooth. To this end, an elongated slot 66 (FIG. 2) is provided on the inner end of the lever 52 surrounding the pivot pin 54 to accommodate the longitudinal movement of the lever 52 as it moves from one ratchet tooth 50 to the next.

Detent means is provided to define the incremental positions of the platen 16. To this end, detent recesses 70 (FIG. 2) are provided on the underside of the platen 16 in a circular pattern spaced slightly inwardly from the outer periphery of the platen. An upwardly biased spring finger 72 (seen to the right in FIG. 2) is formed on the base 12 and has an upwardly protruding rounded boss 74 which seats into the detent recesses 70 as they are incremented sequentially by movement of the ratchet and pawl mechanism described above, particularly movement of the lever 52 from the position shown in FIG. 2 to the end of the slot 60 in the frame 12.

Thus, it can be seen from the above, that not only is the support arm 14 and the impression forming member or members 40 movable in a vertical direction for impression purposes in the clay 22 as well as horizontal positional purposes relative to the receptacle 18 and clay therein, but the platen 16 and receptacle 18 also are incrementally rotated one or more increments to further facilitate different creative designs in the clay. These features, along with the interchangeable impression forming members 40 and the variable longitudinal positions therefor along the support arm 14, as afforded by the apertures 48 therein, permits a child to create practically an infinite number of impressed designs in the clay 22.

The foregoing detailed description has been given for clearness of understanding only and no unnecessary limitations should be understood therefrom as some modifications will be obvious to those skilled in the art.

We claim:

1. A kit for impressing designs in a moldable material, comprising:

a base;

a receptacle on said base for receiving a batch of moldable material;

a selectively movable support arm;

means for mounting said support arm on the base for longitudinal movement relative to the receptacle and for pivotal movement between a first position spaced from said receptacle to permit loading the receptacle with said moldable material and a second position adjacent the receptacle;

a plurality of impression forming members, each having a generally planar contact surface; and means for removably mounting an impression forming member on said support arm for movement therewith and for contacting the moldable material on the receptacle to impress a design in the moldable material when the support arm is in said second position.

2. The kit of claim 1 wherein the means for removably mounting each of said plurality of said impression forming members includes a first coupling element on each of the impression forming members and a second complementary coupling element on said support arm to permit interchangeability and removability of the impression forming members.

3. The kit of claim 2 including a plurality of said second coupling elements on the support arm means for adjusting the position of said impression forming member on said support arm for changing the position of contact of the impression forming member with the moldable material on said receptacle.

4. The kit of claim 1 wherein said support arm mounting means is slidably mounted on said base to permit movement of the support arm to provide multiple in-line impressions on said moldable material.

5. The kit of claim 1 wherein said support arm is mounted to said base by a gimbal connection.

6. The kit of claim 1 including a platen mounted on said base for movement relative thereto and relative to said support arm, said receptacle being mounted on said platen for movement therewith.

7. The kit of claim 1 wherein said support arm is pivotally mounted on said base for movement about a generally horizontal axis and a platen is pivotally mounted on the base on an axis generally perpendicular to that of the support arm.

8. The kit of claim 7 wherein said support arm pivot axis is generally horizontal for generally vertical reciprocating movement and said platen is rotatable about a generally vertical axis.

9. The kit of claim 7 wherein said receptacle is formed by a generally flat tray.

10. The kit of claim 7 including means for moving said platen in equal arcuate increments.

11. The kit of claim 10 wherein said incremental moving means comprises a ratchet and pawl mechanism including a manually movable lever portion.

12. The kit of claim 11 including biasing means for automatically returning said lever portion to an original position after manual incremental movement thereof.

13. The kit of claim 10 including detent means for defining incremental positions of said platen.

14. The kit of claim 1 including means for holding said support arm in said first position for loading purposes.

15. The kit of claim 1 including means for moving said receptacle for movement relative to said base and said support arm.

16. The kit of claim 15 including means for limiting the movement of said receptacle in increments.

17. A kit for impressing designs in clay or the like, comprising:

a base;

a generally horizontal platen mounted on top of the base for rotation relative thereto about a generally vertical axis and having a receptacle on top of the platen for receiving a batch of clay or the like;

a selectively movable support arm mounted on the base by a gimbal connection for movement at least between a first position spaced from the receptacle to permit loading the receptacle with clay and a second position adjacent the receptacle; and an impression forming member on said support arm for movement therewith and for contacting the clay at the receptacle to impress a design in the clay when the support arm is in said second position.

18. The kit of claim 17 including means for holding said support arm in said first position to permit loading clay or the like into said receptacle.

19. The kit of claim 17 including means for rotating said platen and receptacle in discrete, substantially equal increments.

20. The kit of claim 2 wherein said first coupling element provides a snap fit with said second coupling element to maintain said impression forming member on said support arm.

21. The kit of claim 2 including a plurality of said second coupling elements on said support arm for said impression forming members in line with the pivot point of the support arm to change the radial position of the impression forming members for contacting the moldable material.

22. The kit of claim 1 including guide means between said support arm and said base to facilitate proper realignment of said arm on the base after movement.

23. The kit of claim 22 wherein said guide means comprises a plurality of spaced upstanding tabs on said base providing slots for the passage of an arcuate boss on said support arm.

24. A kit or impressing designs in a moldable material, comprising:

a base structure;

a receptacle on said base for receiving a batch of moldable material, said receptacle being formed by a generally flat tray rotatably mounted on said base;

means for moving said platen in equal arcuate increments;

a selectively movably support arm;

means for mounting said support arm on the base for longitudinal movement relative to the receptacle and for pivotal movement between a first position spaced from the receptacle and a second position generally adjacent the receptacle;

a plurality of impression forming members, each impression forming member having a generally flat, two-dimensional contact surface;

means for removably mounting one of said impression forming members on said support arm for movement therewith to contact the moldable material on the receptacle to impress a design therein when the support arm is in said second position, said means for removably mounting said impression forming members including a first coupling element on each of the impression forming members and a second complementary coupling element on said support arm to permit interchangeability and removability of the impression forming members; and guide means between said support arm and said base to facilitate proper realignment of said arm on the base after movement, said guide means comprising a plurality of spaced, upstanding tabs on said base providing slots therebetween for the passage of an arcuate boss formed on said support arm.

* * * * *